US007152445B2

(12) United States Patent
Massee

(10) Patent No.: US 7,152,445 B2
(45) Date of Patent: Dec. 26, 2006

(54) METHOD AND FORMING MACHINE FOR WORKING A WORKPIECE

(76) Inventor: Johan Massee, Vijfsprongweg 104, JC Lunteren (NL) NL-6741

( * ) Notice: Subject to any disclaimer, the term of this patent is extended or adjusted under 35 U.S.C. 154(b) by 0 days.

(21) Appl. No.: 10/890,931

(22) Filed: Jul. 14, 2004

(65) Prior Publication Data

US 2004/0244451 A1 Dec. 9, 2004

Related U.S. Application Data

(63) Continuation of application No. PCT/NL03/00186, filed on Mar. 11, 2003.

(30) Foreign Application Priority Data

Mar. 13, 2002 (NL) ..... 1020171

(51) Int. Cl.
*B21D 22/00* (2006.01)

(52) U.S. Cl. ..... 72/84; 72/115; 72/117; 72/125

(58) Field of Classification Search ..... 72/84, 72/85, 110, 113, 115, 117, 120, 122, 124, 72/125, 86, 370.06, 370.07, 370.08, 393; 29/890

See application file for complete search history.

(56) References Cited

U.S. PATENT DOCUMENTS

| | | | | |
|---|---|---|---|---|
| 1,297,819 A | | 3/1919 | Ferrier | |
| 1,500,261 A | | 7/1924 | Page | |
| 2,358,307 A | | 9/1944 | Dewey | 80/13 |
| 3,055,414 A | | 9/1962 | Boldrini | 153/54 |
| 3,299,680 A | | 1/1967 | Thompson | 72/6 |
| 3,340,713 A | | 9/1967 | Webb | 72/83 |
| 3,380,275 A | | 4/1968 | McGraw | 72/121 |
| 3,533,259 A | | 10/1970 | Marcovitch | 72/110 |
| 3,728,059 A | | 4/1973 | de Putter | |
| 3,851,515 A | | 12/1974 | Hautau | 72/121 |
| 3,857,666 A | * | 12/1974 | Barnett | 425/393 |
| 3,874,209 A | | 4/1975 | Maiorino | 72/91 |
| 3,924,433 A | | 12/1975 | Martin | |
| 4,036,044 A | | 7/1977 | Yoshimura | 72/85 |
| 4,061,009 A | | 12/1977 | Kaporovich et al. | 72/69 |
| 4,091,648 A | | 5/1978 | McCaslin | 72/121 |
| 4,102,168 A | | 7/1978 | Brookes et al. | |
| 4,143,535 A | | 3/1979 | Bouman | 72/119 |
| 4,242,893 A | | 1/1981 | Diller | |
| 4,297,926 A | | 11/1981 | Russ et al. | 82/9 |

(Continued)

FOREIGN PATENT DOCUMENTS

DE 1024046 2/1958

(Continued)

OTHER PUBLICATIONS

PCT Written Opinion, mailed Feb. 16, 2004.

(Continued)

*Primary Examiner*—Ed Tolan
(74) *Attorney, Agent, or Firm*—Westman, Champlin & Kelly P.A.; Steven M. Koehler

(57) ABSTRACT

The invention relates to a method and a forming machine for working a workpiece, for example by deforming it or fixing it in another workpiece, in which the workpiece is fitted over a mandrel, at least a part of the mandrel is expanded so as to fix the workpiece, the workpiece and at least one tool, such as a forming roller, are rotated about an axis relative to each other and the workpiece is worked by means of said tool. Less than half of the expanded or expandable part of the mandrel engages portions of the workpiece that are being worked with the tool.

26 Claims, 3 Drawing Sheets

U.S. PATENT DOCUMENTS

| | | | | | |
|---|---|---|---|---|---|
| 4,327,567 | A | * | 5/1982 | Martin | 72/119 |
| 4,445,352 | A | | 5/1984 | Pols | 72/101 |
| 4,563,887 | A | | 1/1986 | Bressan et al. | 72/84 |
| 4,781,047 | A | * | 11/1988 | Bressan et al. | 72/84 |
| 4,838,064 | A | | 6/1989 | Pass | 72/84 |
| 5,372,028 | A | | 12/1994 | Brilman et al. | 72/117 |
| 5,408,906 | A | | 4/1995 | Gleason | 82/106 |
| 5,419,223 | A | | 5/1995 | Kubler et al. | 82/118 |
| 5,570,603 | A | | 11/1996 | Chatterley | 72/101 |
| 5,571,541 | A | | 11/1996 | Ochsebnbein et al. | 425/393 |
| 5,596,897 | A | | 1/1997 | Payne et al. | 72/84 |
| 5,758,532 | A | | 6/1998 | Massee | 72/83 |
| 5,827,161 | A | | 10/1998 | Petit | 493/102 |
| 5,901,595 | A | | 5/1999 | Massee | 72/81 |
| 5,937,516 | A | | 8/1999 | De Sousa et al. | 29/890 |
| 5,996,386 | A | | 12/1999 | Pazzaglia | 72/84 |
| 6,018,972 | A | | 2/2000 | Irie | 72/121 |
| 6,055,836 | A | | 5/2000 | Waterworth et al. | 72/110 |
| 6,067,833 | A | | 5/2000 | Irie | 72/121 |
| 6,212,926 | B1 | | 4/2001 | Jenness | 72/69 |
| 6,216,512 | B1 | | 4/2001 | Irie | 72/84 |
| 6,233,933 | B1 | | 5/2001 | Petty | 60/584 |
| 6,381,843 | B1 | | 5/2002 | Irie et al. | 72/69 |
| 6,386,010 | B1 | | 5/2002 | Irie et al. | 72/84 |
| 6,739,600 | B1 | | 5/2004 | Dillon et al. | |
| 2004/0093922 | A1 | * | 5/2004 | Mayfield | 72/84 |

FOREIGN PATENT DOCUMENTS

| | | | |
|---|---|---|---|
| DE | 4218092 C1 | | 6/1993 |
| EP | 0125720 | | 11/1984 |
| EP | 0916426 | | 5/1999 |
| EP | 0916428 | | 5/1999 |
| FR | 1004843 | | 4/1952 |
| FR | 2632551 | * | 6/1988 |
| JP | 57-134218 | * | 8/1982 |
| JP | 60261608 | | 12/1985 |
| JP | 62-167956 | | 7/1987 |
| JP | 4115803 | | 4/1992 |
| JP | 10076401 | | 3/1998 |
| JP | 10151501 | | 6/1998 |
| PL | 157062 B | | 4/1992 |
| WO | WO 02/062500 | | 8/1902 |

OTHER PUBLICATIONS

International Search Report PCT/NL 03/00186, mailed Jul. 23, 2003.
EPO Opposition Communications for 0916428.
EPO Opposition Communications for 0916426.
U.S. Appl. No. 10/333,503, filed Jan. 20, 2003.
U.S. Appl. No. 10/333,502, filed Jan. 20, 2003.
U.S. Appl. No. 10/333,505, filed Jan. 20, 2003.

* cited by examiner

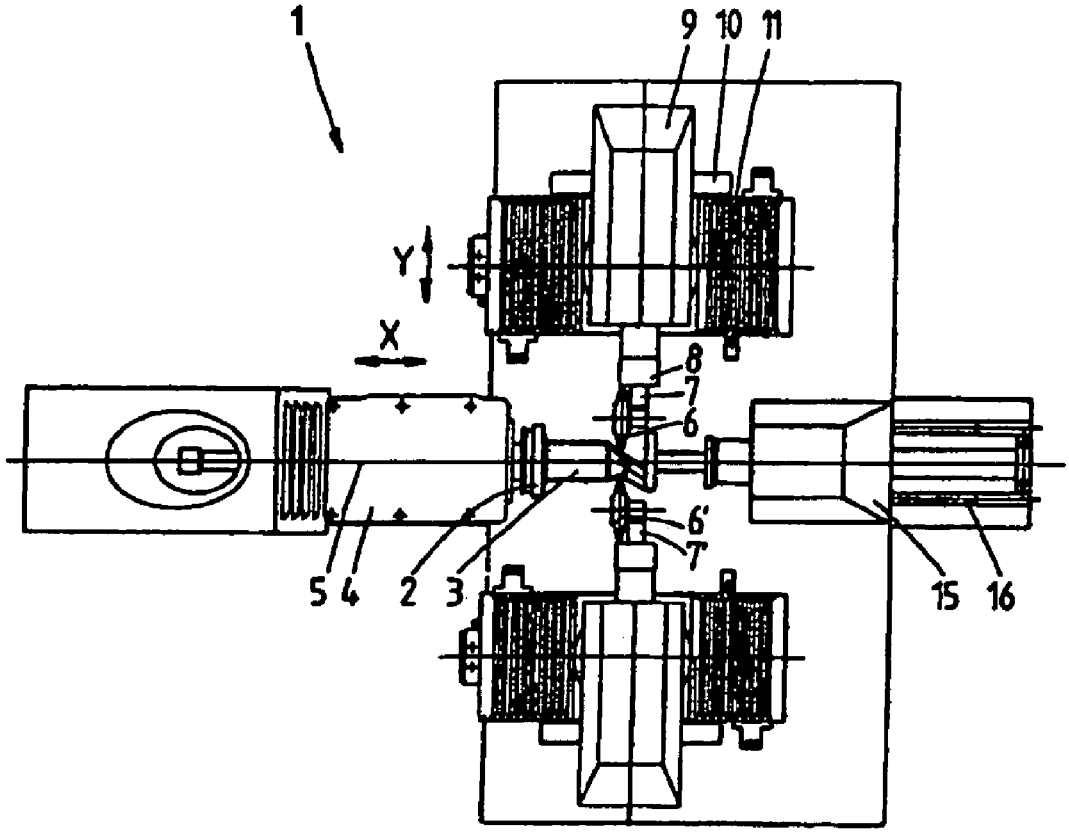
Prior Art fig.1
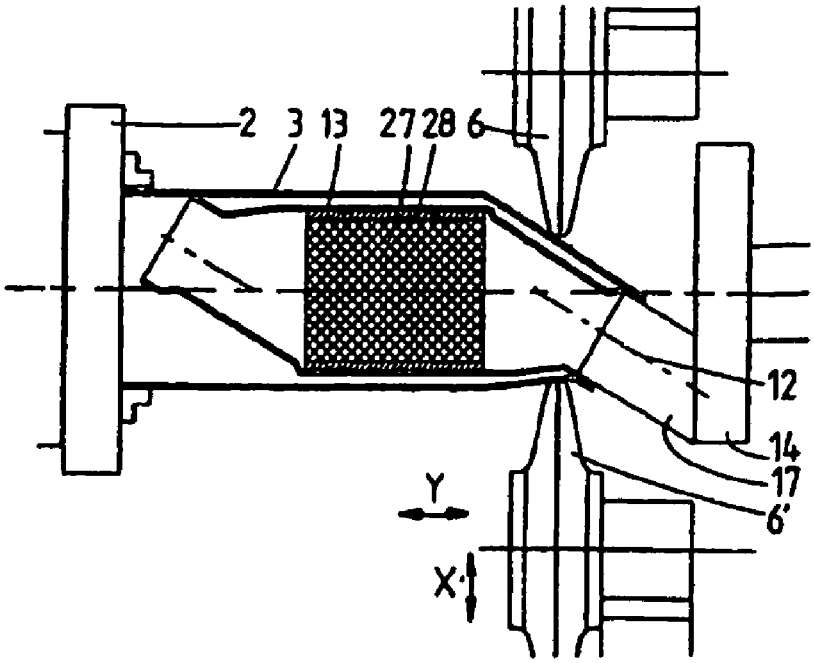
Prior Art fig.2

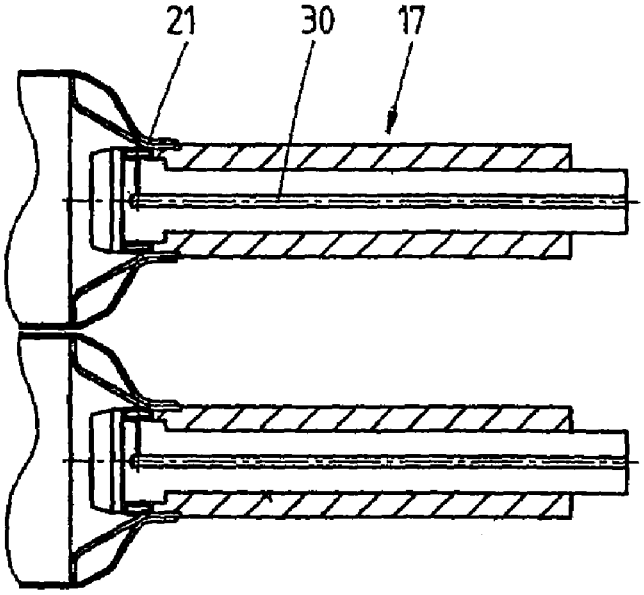
fig.5A
fig.5B
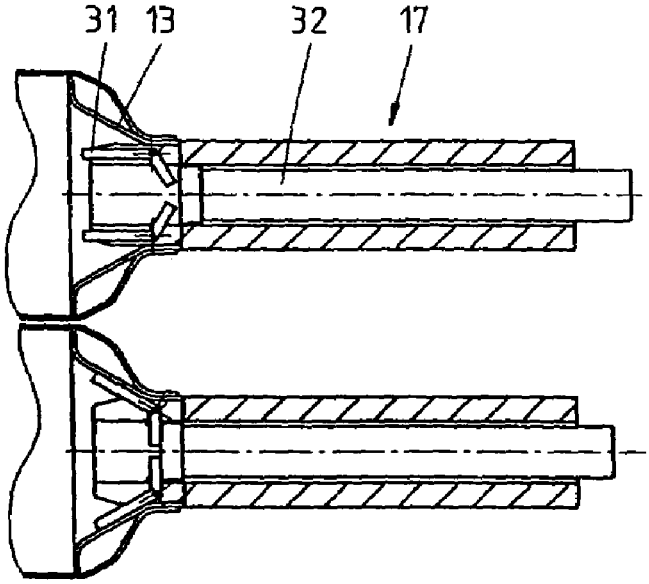
fig.6A
fig.6B

METHOD AND FORMING MACHINE FOR WORKING A WORKPIECE

CROSS-REFERENCE TO RELATED APPLICATIONS

The present application is a continuation of and claims priority of International patent application Serial No. PCT/NL03/00186, filed Mar. 11, 2003, and published in English the content of which is hereby incorporated by reference in its entirety.

BACKGROUND OF THE INVENTION

The invention relates to a method and a forming machine for working a workpiece, for example by deforming it or fixing it in another workpiece, in which the workpiece is fitted over a mandrel, at least a part of the mandrel is expanded so as to fix the workpiece, the workpiece and at least one tool, such as a forming roller, are rotated about an axis relative to each other and the workpiece is worked by means of said tool.

Expandable mandrels are known and they are e.g. locally provided with segments along their circumference, which segments can be moved outwards and inwards. When a workpiece is fixed in position on the mandrel, the segments are moved in outward direction until they engage the inner side of portions of the workpiece that are to be processed. Mandrels of this type are liable to relatively quick wear. In addition, it frequently happens that the workpiece can only be removed from the mandrel with difficulty.

For the sake of completeness it is noted that International patent application PCT/NL01/00939 (not pre-published) makes mention of an expandable mandrel.

SUMMARY OF THE INVENTION

The object of the invention is to improve the method and the forming machine as referred to in the first paragraph.

To this end, the method and the forming machine according to the invention are characterized in that less than half of the expanded or expandable part of the mandrel engages portions of the workpiece that are being worked with the tool. Preferably, the expanded part of the mandrel remains substantially clear of those portions of the workpiece that are being worked.

The load on the expandable part, and thus the extent of wear on the mandrel, is significantly reduced in this manner, and in the case of mandrels whose expandable part is segmented, the material of the workpiece is prevented from being pressed into the openings between the segments during the operation and thus interfere with the contraction of the mandrel.

Preferably, the mandrel is provided with a stop for the workpiece. Thus, workpieces can be mounted on the mandrel in a simple manner, for example by pressing the workpiece against the stop by means of the expandable part of the mandrel, thereby defining the axial position of the workpiece.

Depending inter alia on the nature of the workpiece and of the final product, it is possible to rotate the workpiece while the tool remains stationary in a rotational direction, to rotate the tool while the workpiece remains stationary in the rotational direction or to rotate both. For examples of the various methods reference is made to International patent applications PCT/NL01/00563, PCT/NL01/00564 and PCT/NL01/00565 and to the aforesaid International patent application PCT/NL01/00939.

Within the framework of the invention, the term "mandrel" comprises any device that can be inserted into a workpiece and on which said workpiece can be fixed temporarily.

BRIEF DESCRIPTION OF THE DRAWINGS

The invention will be explained in more detail hereinafter with reference to the appended figures, which show a number of embodiments of the method and the apparatus according to the present invention.

FIG. 1 is a schematic top plan view of an example of a forming machine.

FIG. 2 is a top plan view, partially in section, of a detail of the forming machine of FIG. 1.

FIGS. 5A–6B show two further examples of a mandrel according to the invention.

DETAILED DESCRIPTION OF THE PREFERRED EMBODIMENTS

Figure 3A:
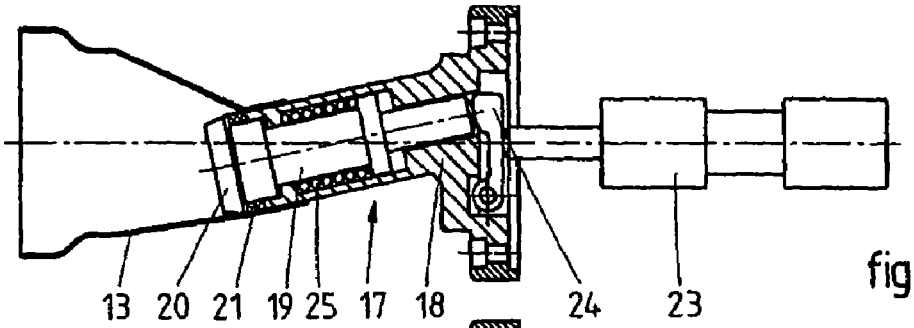
FIGS. 3A and 3B are cross-sectional views of a first embodiment of a mandrel according to the invention for use in the forming machine of FIGS. 1 and 2.

Insofar as parts are identical or have the same function in the various embodiments, said parts will be indicated by the same numerals hereinafter.

FIGS. 1–3B show a forming machine 1 comprising a chuck 2 for setting up a workpiece, such as the illustrated, already deformed metal cylinder 3. The chuck 2 can be rotated about an imaginary axis 5, for example by means of an electric or hydraulic motor present within the housing 4. Disposed on either side of the workpiece 3 is a forming tool, such as a forming roller 6, 6', which is rotatably mounted on a respective holder 7, 7', which is fitted in an upper slide 8 in a housing 9. The upper slide 8, and thus the forming roller 6, can be reciprocated over a guide present in the housing 9, for example by means of a hydraulic servo motor or cylinder, in a (Y) direction extending at angle of e.g. 45–90° to the axis 5.

The housing 9 is mounted on a lower slide 10, which is largely hidden from view by bellows 11 and which is mounted on a guide, which in turn forms part of a machine bed. The lower slide 10 can be reciprocated over said guide 12, also in this case by means of a hydraulic servo motor or cylinder, for example, in an (X) direction extending perpendicularly to the direction of movement of the upper slide 8.

For more details on a suitable example of an assembly of a forming roller and the associated slide and driving means, reference is made to European patent application EP 0 125 720.

In the operation that is shown in FIGS. 1–3, the cylinder 3 is rotated at a suitable speed, while the forming rollers 6, 6' are pressed against the outer wall thereof. The forming rollers 6, 6' are driven in such a manner that they translate reciprocatingly in the Y-direction with a frequency that has been adapted to the frequency of the rotation of the cylinder 3, in order to thus follow and further deform the deformed part, the central axis 12 of which includes an angle with the axis 5.

Following that, the forming rollers 6, 6' and the cylinder 3 are moved in the X-direction relative to each other, for example in such a manner that the forming rollers 6, 6' are initially spaced from the end of the workpiece 3 by some distance and subsequently move towards said end. During this movement, the relevant part of the workpiece can be deformed by adjusting the reciprocating translating movement of the forming rollers 6, 6'. Depending inter alia on the properties of the material, the wall thickness, the extent of deformation and diameter reduction, a larger or smaller number of working passes or steps will be required.

Present in the cylinder 3 is an insert piece 13. To this end the forming machine 1 is provided with a forming head 14, which is rotatably mounted (about the axis 5) in a housing 15, which housing can be reciprocated, by means of a slide (not shown), over two guide rails 16, which are in line with the axis 5. The head 14 may freely rotate or be rotated about the imaginary axis 5, for example by means of an electric motor disposed within the housing 15, and it is provided with an eccentric, sloping mandrel 17, on which the insert piece 13 is clamped down.

During operation, the end and the edge of the end of the cylinder 3 are deformed to conform to the shape of the end and the cylindrical edge of the end of the insert piece 13 by means of the forming rollers 6, 6', as described above, after which said edges form a strong and possibly gastight (clamped) connection.

Figure 3B:
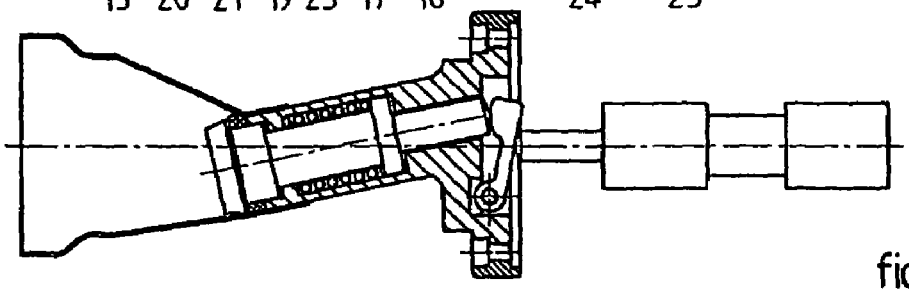
Figure 4A:
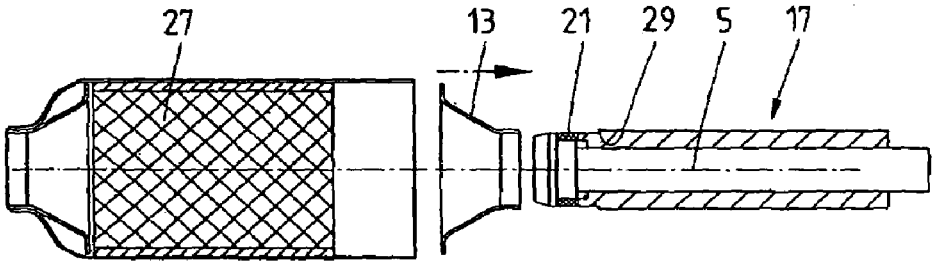
FIGS. 4A–4D show four steps of an example of a method according to the present invention.
Figure 4B:
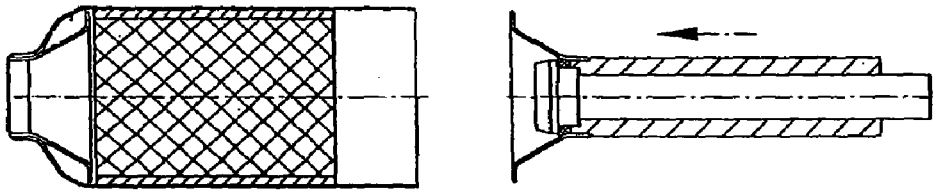
Figure 4C:
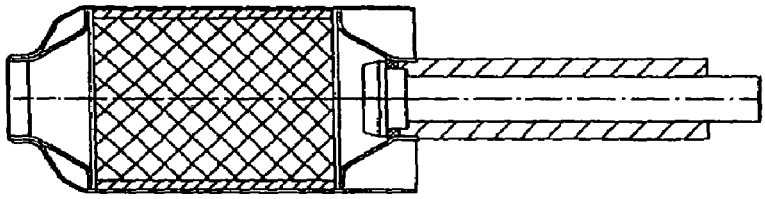
Figure 4D:
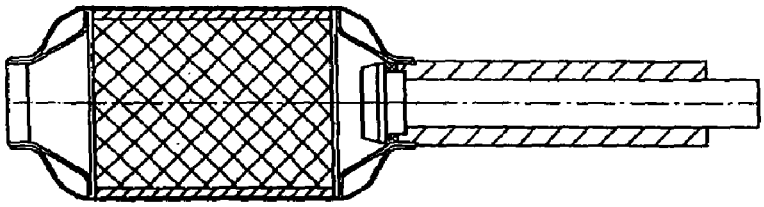

FIG. 2 schematically shows a mandrel according to the prior art, while FIGS. 3A and 3B show a mandrel 17 according to the invention, which can be used in the forming machine 1. Said mandrel 17 comprises an outer portion 18, within which an inner portion 19 is present, which inner portion can be reciprocated in the axial direction of the mandrel 17. At the location of the end of the mandrel 17, the inner portion 19 comprises a (frusto)conical portion 20, whose circumference substantially corresponds to the circumference of the end of the outer portion 18 as regards the shape, a circularly cylindrical shape in this specific example, and the dimensions. Positioned between the conical portion 20 and the end of the outer portion 18 is an element, a ring 21 in this example, which is expandable in radial direction. Such a ring 21 may be made of an elastic, at any rate a flexible material, e.g. rubber or a metal coil spring.

In FIG. 3A the inner portion 19 is pressed away from the end of the outer portion 18 against the action of a spring 25 by pressure means 22, in this example a pneumatic or hydraulic stamp 23 which cooperates with a rocker 24. As a result, the ring 21 is hardly loaded, if at all, in the axial direction, and said ring 21 has an external diameter that corresponds to or is smaller than the largest external diameter of the cone 20. In this condition it is possible to slide the insert piece 13 over the mandrel 17. Once the insert piece 13 has reached the desired axial position, the force that is exerted on the inner part 19 with the aforesaid pressure means is reduced to such an extent that the conical portion 20 is moved in the direction of the outer portion 18 by the spring 25. As a result, the ring 21 is compressed in the axial direction, causing it to expand in the radial direction and engage the inner side of the insert piece 13 just behind the cylindrical edge to be worked.

The insert piece 13 that is shown in the examples consists of an inner housing 26 or a part thereof for catalytic converter units for passenger cars and the like. The insert piece 13 that is shown in FIG. 2 moreover comprises a so-called catalytic brick or substrate 27 provided with an insulating casing 28.

FIGS. 4A–4D show four steps of a method in which the cylinder 3, an insert piece 13 and a mandrel 17, which is again provided with an expandable ring 21 in this example, are positioned on the same axis 5. The mandrel 17 is moreover provided with a ring-shaped stop 29 in this example. The insert piece 13 substantially consists of a rotationally symmetrical cone, which cone terminates in a circularly cylindrical end.

In a first step, the insert piece 13 is slid over the mandrel 17 in the axial direction until it butts against the stop 29. Then the ring 21, which is positioned near the transition between the cone and the end at that point, is expanded in the radial direction (cf. FIGS. 3A and 3B), with the ring 21 engaging the inner side of said parts and in addition pressing the insert piece 13 firmly against the stop 29. Then the insert piece 13, whose position relative to the mandrel 17 is fixed at that point, is placed into the cylinder 3 and accurately positioned relative to a part that is present therein, for example a substrate 27, by means of said mandrel 17. Following that, the end of the cylinder 3 can be closed by means of forming rollers (not shown), with the (axial and radial) positions of the insert piece 13 relative to the substrate 27 and the cylinder 3 remaining constant. As soon as the cylinder 3 is closed, the expansion of the ring 21 is undone and the finished or semi-finished product thus obtained can be removed from the mandrel 17.

FIGS. 5A and 5B show the position of the rest and the expanded position of a variant of the mandrel 17 according to FIGS. 4A–4D. This variant comprises a hollow ring 21 made of an elastic, at any rate a flexible material, which can be filled with a gas or a liquid via a pipe 30 so as to cause the circumference of the ring to increase in the radial direction.

FIGS. 6A and 6B show a variant, in which one or more brackets 31 are arranged along the circumference of the end of the mandrel 17, being rotatable about a point located near their centre. The rear end of each of said brackets 31 extends radially inwardly. When a pressure is exerted on said rear ends by means of a stamp 32, the front end of said brackets 31 will move outwardly until they engage the inner side of a workpiece 13.

Although the examples as described above are combinations of workpieces in all cases, the forming machines and the methods according to the invention are also suitable for working one-part workpieces, of course.

The forming machines according to the invention preferably comprise a control unit. Such a control unit is for example arranged for controlling the means for moving the rollers in the X-, Y- and radial directions according to a control programme stored in a memory, in such a manner that the forming rollers will follow one or more desired paths for deforming the workpiece into the desired finished or semi-finished product.

The invention is not limited to the embodiments as described in the foregoing, which can be varied in several ways within the scope of the invention as defined in the claims. Thus, the mandrel can be adapted to products having different shapes. Besides the concentric and sloping mandrels as described above, it is also possible to use a mandrel whose central axis extends eccentrically with respect to the central axis of the (second) workpiece, for example.

What is claimed is:

1. A method for working a workpiece, in which:

the workpiece is fitted over a mandrel, at least a part of the mandrel is expandable and is expanded so as to fix the workpiece;

the workpiece and one or more tools are rotated about an axis relative to each other and the workpiece is worked by means of said tool; and wherein less than half of the expanded or expandable part of the mandrel engages portions of the workpiece that are being worked with the tool.

2. The method according to claim 1, wherein the expanded part of the mandrel remains substantially clear of those portions of the workpiece that are being worked.

3. The method according to claim 1, wherein the first-mentioned workpiece is inserted into a second workpiece, said second workpiece is deformed by means of the tool, thus fixing the first-mentioned workpiece in the second workpiece.

4. The method according to claim 3, wherein a central axis of the mandrel extends at an angle to and/or is positioned eccentrically with respect to the central axis of the second workpiece.

5. The method according to claim 1, wherein the workpiece is pressed into abutment with a stop on the mandrel.

6. The method of claim 1 wherein said at least part of the mandrel comprises at least one bracket arranged along a circumference of the mandrel and being rotatable about a point between its ends, and wherein expanding the mandrel comprises rotating said at least one bracket so as to fix the workpiece.

7. A forming machine for working a workpiece, comprising:

an at least partially expandable mandrel for fixing the workpiece;

at least one tool for working the workpiece;

driving means for rotating the workpiece and the tool relative to each other about an axis; and wherein the mandrel is adapted to the workpiece in such a manner that less than half of the expandable part of the mandrel engages portions of the workpiece that are being worked with the tool.

8. The forming machine according to claim 7, wherein the expandable part has been adapted to the workpiece in such a manner that the expandable part of the mandrel remains substantially clear of those portions of the workpiece that are being worked.

9. The forming machine according to claim 7, which moreover comprises a chuck for a second workpiece.

10. The forming machine according claim 7, wherein the central axis of the mandrel extends at an angle to and/or is positioned eccentrically with respect to the central axis of the chuck for the second workpiece.

11. The forming machine claim 7, wherein said mandrel is provided with a stop for the workpiece.

12. The forming machine of claim 7 wherein said at least partially expandable mandrel comprises at least one bracket arranged along a circumference of the mandrel, the at least one bracket being rotatable about a point between its ends.

13. The forming machine according to claim 12 wherein said at least partially expandable mandrel comprises a set of brackets arranged along a circumference of the mandrel, each of the brackets being rotatable about a point between its ends.

14. The forming machine according to claim 13 wherein the mandrel includes a stamp adapted to drive the set of brackets.

15. The forming machine according to claim 14 wherein the mandrel includes an axial bore wherein the stamp is axially displaceable in the bore.

16. The forming machine according to claim 12 wherein the mandrel includes a stamp adapted to drive the at least one bracket.

17. The forming machine according to claim 16 wherein the mandrel includes an axial bore wherein the stamp is axially displaceable in the bore.

18. A method for working a workpiece, comprising:

fitting the workpiece over a mandrel wherein fitting includes abutting the workpiece with a stop of the mandrel to obtain a desired axial position of the workpiece on the mandrel;

expanding at least a part of the mandrel so as to fix the workpiece thereon;

rotating at least one of the workpiece and a tool relative to each other about an axis; and working a portion of the workpiece with the tool wherein the expanded part of the mandrel remains substantially clear of those portions of the workpiece that are being worked.

19. The method of claim 18 and further comprising inserting the first-mentioned workpiece into a second workpiece; and wherein working comprises deforming a portion of the second workpiece with the tool to couple the first-mentioned workpiece with the second workpiece.

20. The method of claim 18 wherein said at least part of the mandrel comprises at least one bracket arranged along a circumference of the mandrel and being rotatable about a point between its ends, and wherein expanding the mandrel comprises rotating said at least one bracket so as to fix the workpiece.

21. A forming machine for working a workpiece, the forming machine comprising:

a tool adapted to perform work on a workpiece;

a mandrel having an at least partially expandable part adapted to hold the workpiece fixed to the mandrel, and a stop adapted to engage the workpiece to obtain a desired axial position of the workpiece on the mandrel, wherein the tool is disposed relative to the mandrel such that the expandable part of the mandrel remains substantially clear of portions of the workpiece that are being worked; and a drive coupled to at least one of the mandrel and the tool and adapted to rotate at least one of the mandrel and the tool relative to each other about an axis.

22. The forming machine according claim 21, wherein the central axis of the mandrel extends at an angle to and/or is positioned eccentrically with respect to the central axis of the chuck for the second workpiece.

23. The forming machine according to claim 22, and further comprising a chuck for a second workpiece.

24. The forming machine of claim 22 wherein said at least partially expandable part of the mandrel comprises at least one bracket arranged along a circumference of the mandrel, the at least one bracket being rotatable about a point between its ends.

25. The forming machine according to claim 22 wherein said at least partially expandable part of the mandrel includes a set of brackets arranged along a circumference of the mandrel, each of the brackets being rotatable about a point between its ends.

26. The forming machine according to claim 25 wherein the mandrel includes a stamp adapted to drive the set of brackets.

* * * * *